US009304469B2

(12) United States Patent
Koganehira et al.

(10) Patent No.: US 9,304,469 B2
(45) Date of Patent: Apr. 5, 2016

(54) INFORMATION PROCESSING DEVICE AND PROGRAM

(71) Applicant: SEIKO EPSON CORPORATION, Tokyo (JP)

(72) Inventors: Shuichi Koganehira, Matsumoto (JP); Takefumi Inui, Matsumoto (JP); Kenji Matsumoto, Chino (JP); Tomohiko Sano, Shiojiri (JP); Yuki Kuwahara, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/665,573

(22) Filed: Mar. 23, 2015

(65) Prior Publication Data

US 2015/0277328 A1 Oct. 1, 2015

(30) Foreign Application Priority Data

Mar. 25, 2014 (JP) ..... 2014-062309

(51) Int. Cl.
*B41J 2/15* (2006.01)
*G03G 15/00* (2006.01)

(52) U.S. Cl.
CPC ..... *G03G 15/556* (2013.01)

(58) Field of Classification Search
CPC ..... B41J 2/21; B41J 2/2121; G06F 3/1242; G06F 11/0733; G06F 17/3028; G06F 21/84
See application file for complete search history.

(56) References Cited

U.S. PATENT DOCUMENTS

| | | | | |
|---|---|---|---|---|
| 6,464,319 | B1 * | 10/2002 | Teshigawara | B41J 2/2135 347/19 |
| 6,532,026 | B2 * | 3/2003 | Takahashi | B41J 19/145 347/19 |
| 6,547,360 | B2 * | 4/2003 | Takahashi | B41J 2/125 347/19 |
| 6,571,071 | B2 | 5/2003 | Kanoshima et al. | |
| 2002/0191039 | A1 | 12/2002 | Minowa et al. | |
| 2003/0020951 | A1 | 1/2003 | Minowa et al. | |
| 2006/0159634 | A1 | 7/2006 | Heinrichs | |
| 2010/0202017 | A1 | 8/2010 | Sano | |

FOREIGN PATENT DOCUMENTS

| | | |
|---|---|---|
| JP | 06-192193 | 7/1994 |
| JP | 2002-174995 | 6/2002 |
| JP | 2002-373072 | 12/2002 |
| JP | 2003-025686 | 1/2003 |
| JP | 2006-199684 | 8/2006 |
| JP | 2010-184371 | 8/2010 |

* cited by examiner

*Primary Examiner* — Lamson Nguyen
(74) *Attorney, Agent, or Firm* — Workman Nydegger

(57) ABSTRACT

An information processing device includes an ink distribution amount computation unit that computes an i-th (where i is an integer greater than or equal to one) ink distribution amount distributed to an i-th recording job which is performed by a recording apparatus according to an i-th ink distribution ratio obtained from division of an i-th total consumption amount cumulative total by an i-th recording consumption amount cumulative total.

11 Claims, 10 Drawing Sheets

| RECORDING JOB | CONSUMPTION AMOUNT IN RECORDING | CONSUMPTION AMOUNT IN NON-RECORDING | DISTRIBUTION TARGET AMOUNT | CARRY-OVER TARGET AMOUNT | ADDITION AMOUNT | NEXT CARRY-OVER AMOUNT | CONSUMPTION AMOUNT IN RECORDING CUMULATIVE TOTAL | TOTAL CONSUMPTION AMOUNT CUMULATIVE TOTAL | DISTRIBUTION AMOUNT BEFORE ADDITION | INK DISTRIBUTION AMOUNT | INK COST |
|---|---|---|---|---|---|---|---|---|---|---|---|
| | $a_i$ [g] | $b_i$ [g] | $c_i$ [g] | $d_i$ [g] | $e_i$ [g] | $f_i$ [g] | $g_i$ [g] | $h_i$ [g] | $j_i$ [g] | $k_i$ [g] | $m_i$ [YEN] |
| #1 | 2.0 | 15 → 3.5 | 3.5 | 11.5 | 2.30 | 9.20 | 2.00 | 5.50 | 5.50 | 7.80 | 78 |
| #2 | 2.0 | 5 → 3.5 | 3.5 | 1.5 | 2.14 | 8.56 | 4.00 | 11.00 | 5.50 | 7.64 | 76 |
| #3 | 2.0 | 5 → 3.5 | 3.5 | 1.5 | 2.01 | 8.05 | 6.00 | 16.50 | 5.50 | 7.51 | 75 |
| #4 | 12.0 | 5.0 | 18.5 | 0.0 | 0.16 | 7.89 | 18.00 | 33.50 | 22.33 | 22.49 | 225 |
| #5 | 2.0 | 15 → 3.5 | 3.5 | 11.5 | 3.88 | 15.51 | 20.00 | 39.00 | 3.90 | 7.78 | 78 |
| #6 | 2.0 | 5 → 3.5 | 3.5 | 1.5 | 3.40 | 13.61 | 22.00 | 44.50 | 4.05 | 7.45 | 74 |
| #7 | 2.0 | 5 → 3.5 | 3.5 | 1.5 | 3.02 | 12.09 | 24.00 | 50.00 | 4.17 | 7.19 | 72 |
| #8 | 12.0 | 5.0 | 18.5 | 0.0 | 0.24 | 11.84 | 36.00 | 67.00 | 22.33 | 22.58 | 226 |
| #9 | 2.0 | 15 → 3.5 | 3.5 | 11.5 | 4.67 | 18.68 | 38.00 | 72.50 | 3.82 | 8.48 | 85 |
| #10 | 2.0 | 5 → 3.5 | 3.5 | 1.5 | 4.04 | 16.14 | 40.00 | 78.00 | 3.90 | 7.94 | 79 |
| #11 | 2.0 | 5 → 3.5 | 3.5 | 1.5 | 3.53 | 14.11 | 42.00 | 83.50 | 3.98 | 7.50 | 75 |
| #12 | 12.0 | 5.0 | 18.5 | 0.0 | 0.28 | 13.83 | 54.0 → 5.40 | 100.5 → 10.05 | 22.33 | 22.62 | 226 |
| #13 | 12.0 | 15.0 | 18.5 | 0.0 | 0.28 | 13.55 | 17.40 | 37.05 | 25.55 | 25.83 | 258 |
| #14 | 2.0 | 5 → 3.5 | 3.5 | 1.5 | 3.01 | 12.04 | 19.40 | 42.55 | 4.39 | 7.40 | 74 |
| #15 | 2.0 | 5 → 3.5 | 3.5 | 1.5 | 2.71 | 10.83 | 21.40 | 48.05 | 4.49 | 7.20 | 72 |
| #16 | 12.0 | 5.0 | 18.5 | 0.0 | 0.22 | 10.62 | 33.40 | 65.05 | 23.37 | 23.59 | 236 |

FIG. 3

| RECORDING JOB | CONSUMPTION AMOUNT IN RECORDING [g] | CONSUMPTION AMOUNT IN NON-RECORDING [g] | INK COST [YEN] |
|---|---|---|---|
| #1 | 2 | 15 | 170 |
| #2 | 2 | 5 | 70 |
| #3 | 2 | 5 | 70 |
| #4 | 12 | 5 | 170 |
| #5 | 2 | 15 | 170 |
| #6 | 2 | 5 | 70 |
| #7 | 2 | 5 | 70 |
| #8 | 12 | 5 | 170 |
| #9 | 2 | 15 | 170 |
| #10 | 2 | 5 | 70 |
| #11 | 2 | 5 | 70 |
| #12 | 12 | 5 | 170 |
| #13 | 12 | 15 | 270 |
| #14 | 2 | 5 | 70 |
| #15 | 2 | 5 | 70 |
| #16 | 2 | 5 | 70 |

FIG. 7A

B: NOT SET, C = 1

| | CONSUMPTION AMOUNT IN RECORDING | DISTRIBUTION TARGET AMOUNT | CONSUMPTION AMOUNT IN RECORDING CUMULATIVE TOTAL | TOTAL CONSUMPTION AMOUNT CUMULATIVE TOTAL | INK DISTRIBUTION RATE |
|---|---|---|---|---|---|
| | $a_i$ [g] | $c_i$ [g] | $g_i$ [g] | $h_i$ [g] | $h_i/g_i$ |
| PREVIOUS | | | 900 | 990 | 1.10 |
| CURRENT | 15 | 10 | 915 | 1015 | 1.11 |
| NEXT | 15 | 10 | 930 | 1040 | 1.12 |

FIG. 7B

B = 1000, C = 10

| | CONSUMPTION AMOUNT IN RECORDING | DISTRIBUTION TARGET AMOUNT | CONSUMPTION AMOUNT IN RECORDING CUMULATIVE TOTAL | TOTAL CONSUMPTION AMOUNT CUMULATIVE TOTAL | INK DISTRIBUTION RATE |
|---|---|---|---|---|---|
| | $a_i$ [g] | $c_i$ [g] | $g_i$ [g] | $h_i$ [g] | $h_i/g_i$ |
| PREVIOUS | | | 900 | 990 | 1.10 |
| CURRENT | 15 | 10 | 91.5 | 101.5 | 1.11 |
| NEXT | 15 | 10 | 106.5 | 126.5 | 1.19 |

FIG. 7C

B = 1000, C = 100

| | CONSUMPTION AMOUNT IN RECORDING | DISTRIBUTION TARGET AMOUNT | CONSUMPTION AMOUNT IN RECORDING CUMULATIVE TOTAL | TOTAL CONSUMPTION AMOUNT CUMULATIVE TOTAL | INK DISTRIBUTION RATE |
|---|---|---|---|---|---|
| | $a_i$ [g] | $c_i$ [g] | $g_i$ [g] | $h_i$ [g] | $h_i/g_i$ |
| PREVIOUS | | | 900 | 990 | 1.10 |
| CURRENT | 15 | 10 | 9.15 | 10.15 | 1.11 |
| NEXT | 15 | 10 | 24.15 | 35.15 | 1.46 |

FIG. 7D

B = 100, C = 10

| | CONSUMPTION AMOUNT IN RECORDING | DISTRIBUTION TARGET AMOUNT | CONSUMPTION AMOUNT IN RECORDING CUMULATIVE TOTAL | TOTAL CONSUMPTION AMOUNT CUMULATIVE TOTAL | INK DISTRIBUTION RATE |
|---|---|---|---|---|---|
| | $a_i$ [g] | $c_i$ [g] | $g_i$ [g] | $h_i$ [g] | $h_i/g_i$ |
| PREVIOUS | | | 90 | 99 | 1.10 |
| CURRENT | 15 | 10 | 10.5 | 12.4 | 1.18 |
| NEXT | 15 | 10 | 25.5 | 37.4 | 1.47 |

FIG. 7E

B = 10, C = 10

| | CONSUMPTION AMOUNT IN RECORDING | DISTRIBUTION TARGET AMOUNT | CONSUMPTION AMOUNT IN RECORDING CUMULATIVE TOTAL | TOTAL CONSUMPTION AMOUNT CUMULATIVE TOTAL | INK DISTRIBUTION RATE |
|---|---|---|---|---|---|
| | $a_i$ [g] | $c_i$ [g] | $g_i$ [g] | $h_i$ [g] | $h_i/g_i$ |
| PREVIOUS | | | 9.0 | 9.9 | 1.10 |
| CURRENT | 15 | 10 | 2.4 | 3.49 | 1.45 |
| NEXT | 15 | 10 | 1.74 | 2.84 | 1.63 |

FIG. 8

| RECORDING JOB | CONSUMPTION AMOUNT IN RECORDING | CONSUMPTION AMOUNT IN NON-RECORDING | DISTRIBUTION TARGET AMOUNT | CARRY-OVER TARGET AMOUNT | ADDITION AMOUNT | NEXT CARRY-OVER AMOUNT | CONSUMPTION AMOUNT IN RECORDING CUMULATIVE TOTAL | TOTAL CONSUMPTION AMOUNT CUMULATIVE TOTAL | DISTRIBUTION AMOUNT BEFORE ADDITION | INK DISTRIBUTION AMOUNT | INK COST |
|---|---|---|---|---|---|---|---|---|---|---|---|
| | $a_i$ [g] | $b_i$ [g] | $c_i$ [g] | $d_i$ [g] | $e_i$ [g] | $f_i$ [g] | $g_i$ [g] | $h_i$ [g] | $j_i$ [g] | $k_i$ [g] | $m_i$ [YEN] |
| #1 | 2.0 | 15 → 3.5 | 3.5 | 11.5 | 2.30 | 9.20 | 2.00 | 5.50 | 5.50 | 7.80 | 78 |
| #2 | 2.0 | 5 → 3.5 | 3.5 | 1.5 | 2.14 | 8.56 | 4.00 | 11.00 | 5.50 | 7.64 | 76 |
| #3 | 2.0 | 5 → 3.5 | 3.5 | 1.5 | 2.01 | 8.05 | 6.00 | 16.50 | 5.50 | 7.51 | 75 |
| #4 | 12.0 | 5.0 | 18.5 | 0.0 | 0.16 | 7.89 | 18.00 | 33.50 | 22.33 | 22.49 | 225 |
| #5 | 2.0 | 15 → 3.5 | 3.5 | 11.5 | 3.88 | 15.51 | 20.00 | 39.00 | 3.90 | 7.78 | 78 |
| #6 | 2.0 | 5 → 3.5 | 3.5 | 1.5 | 3.40 | 13.61 | 22.00 | 44.50 | 4.05 | 7.45 | 74 |
| #7 | 2.0 | 5 → 3.5 | 3.5 | 1.5 | 3.02 | 12.09 | 24.00 | 50.00 | 4.17 | 7.19 | 72 |
| #8 | 12.0 | 5.0 | 18.5 | 0.0 | 0.24 | 11.84 | 36.00 | 67.00 | 22.33 | 22.58 | 226 |
| #9 | 2.0 | 15 → 3.5 | 3.5 | 11.5 | 4.67 | 18.68 | 38.00 | 72.50 | 3.82 | 8.48 | 85 |
| #10 | 2.0 | 5 → 3.5 | 3.5 | 1.5 | 4.04 | 16.14 | 40.00 | 78.00 | 3.90 | 7.94 | 79 |
| #11 | 2.0 | 5 → 3.5 | 3.5 | 1.5 | 3.53 | 14.11 | 42.00 | 83.50 | 3.98 | 7.50 | 75 |
| #12 | 12.0 | 5.0 | 18.5 | 0.0 | 0.28 | 13.83 | 54.0 → 5.40 | 100.5 → 10.05 | 22.33 | 22.62 | 226 |
| #13 | 12.0 | 15.0 | 18.5 | 0.0 | 0.28 | 13.55 | 17.40 | 37.05 | 25.55 | 25.83 | 258 |
| #14 | 2.0 | 5 → 3.5 | 3.5 | 1.5 | 3.01 | 12.04 | 19.40 | 42.55 | 4.39 | 7.40 | 74 |
| #15 | 2.0 | 5 → 3.5 | 3.5 | 1.5 | 2.71 | 10.83 | 21.40 | 48.05 | 4.49 | 7.20 | 72 |
| #16 | 12.0 | 5.0 | 18.5 | 0.0 | 0.22 | 10.62 | 33.40 | 65.05 | 23.37 | 23.59 | 236 |

INFORMATION PROCESSING DEVICE AND PROGRAM

BACKGROUND

1. Technical Field

The present invention relates to an information processing device and a program that compute the amount of distribution of ink distributed to each recording job so as to, for example, compute the ink cost in each recording job.

2. Related Art

In the related art, there is known a printing device that allocates the amount of usage of ink used in other jobs except a printing job, that is, the amount of usage of maintenance ink to each printing job to compute the sum of the amount of usage of ink used in a printing job and the allocated amount of usage of ink for each printing job. This is intended to compute the ink cost in each printing job when a printing device is shared by a plurality of people in an office or the like or by a plurality of departments. The printing device, for example, allocates the amount of usage of maintenance ink to a plurality of printing jobs which is the target for allocation either evenly or depending on the proportion of the amount of usage of ink in each printing job which is the target for allocation. More specifically, when the amount of usage of maintenance ink is 1 ml, the amount of usage of maintenance ink is allocated to a job A and a job B either evenly by 0.5 ml each or depending on the amount of usage of ink in the job A (2 ml) and the amount of usage of ink in the job B (8 ml) by 0.2 ml for the job A and 0.8 ml for the job B (refer to JP-A-2010-184371).

As such, the printing device in the related art can allocate the amount of usage of maintenance ink to a plurality of printing jobs at the time of the end of a plurality of printing jobs. However, the printing device in the related art does not consider how to appropriately allocate the amount of usage of maintenance ink to a printing job at the time of the end of the printing job.

SUMMARY

An advantage of some aspects of the invention is to provide an information processing device and a program that can appropriately compute the amount of ink distributed to a recording job at the time of the end of the recording job.

According to an aspect of the invention, there is provided an information processing device including an ink distribution amount computation unit that computes an i-th (where i is an integer greater than or equal to one) ink distribution amount distributed to an i-th recording job which is performed by a recording apparatus according to an i-th ink distribution ratio obtained from division of an i-th total consumption amount cumulative total by an i-th recording consumption amount cumulative total.

It is preferable that the information processing device further includes a first counting unit that counts an i-th recording consumption amount which is the amount of ink consumed in the i-th recording job performed by the recording apparatus, a second counting unit that counts an i-th non-recording consumption amount which is the amount of ink consumed in a non-recording job except the recording job, the non-recording job being performed by the recording apparatus between the (i−1)-th recording job and the i-th recording job, a consumption amount cumulative total storage unit that stores the (i−1)-th recording consumption amount cumulative total and the (i−1)-th total consumption amount cumulative total, and a consumption amount cumulative total computation unit that computes the i-th recording consumption amount cumulative total on the basis of a value obtained from addition of the (i−1)-th recording consumption amount cumulative total and the i-th recording consumption amount and computes the i-th total consumption amount cumulative total on the basis of a value obtained from addition of the (i−1)-th total consumption amount cumulative total, the i-th recording consumption amount, and the i-th non-recording consumption amount, in which the ink distribution amount computation unit computes the i-th ink distribution amount on the basis of a value obtained from multiplication of the i-th ink distribution ratio by the i-th recording consumption amount.

According to another aspect of the invention, there is provided a program that allows a computer to perform counting an i-th (where i is an integer greater than or equal to one) recording consumption amount which is the amount of ink consumed in an i-th recording job performed by a recording apparatus, counting an i-th non-recording consumption amount which is the amount of ink consumed in a non-recording job except the recording job, the non-recording job being performed by the recording apparatus between the (i−1)-th recording job and the i-th recording job, reading the (i−1)-th recording consumption amount cumulative total and an (i−1)-th total consumption amount cumulative total from a storage unit, computing the i-th recording consumption amount cumulative total on the basis of a value obtained from addition of the (i−1)-th recording consumption amount cumulative total and the i-th recording consumption amount and computing the i-th total consumption amount cumulative total on the basis of a value obtained from addition of the (i−1)-th total consumption amount cumulative total, the i-th recording consumption amount, and the i-th non-recording consumption amount, and computing an i-th ink distribution amount distributed to the i-th recording job on the basis of a value obtained from multiplication of the i-th recording consumption amount by an i-th ink distribution ratio that is obtained from division of the i-th total consumption amount cumulative total by the i-th recording consumption amount cumulative total.

In this case, the i-th recording consumption amount cumulative total and the total consumption amount cumulative total can be computed at the time of the end of the i-th recording job. The i-th ink distribution amount is computed on the basis of the i-th ink distribution ratio which is the ratio of the i-th total consumption amount cumulative total to the computed i-th recording consumption amount cumulative total. Thus, the i-th ink distribution amount on which the i-th ink distribution ratio, that is, the operation status of the recording apparatus until the i-th recording job is reflected can be obtained. Therefore, the ink distribution amount distributed to the i-th recording job can be appropriately computed at the time of the end of the i-th recording job.

It is preferable that the information processing device further includes a cumulative total upper limit storage unit that stores a cumulative total upper limit, a reference divisor storage unit that stores a reference divisor which is a number greater than one, and a cumulative total upper limit determining unit that determines whether the i-th total consumption amount cumulative total exceeds the cumulative total upper limit, in which the consumption amount cumulative total computation unit does not correct the i-th recording consumption amount and the i-th total consumption amount cumulative total when the cumulative total upper limit determining unit determines that the i-th total consumption amount cumulative total is less than or equal to the cumulative total upper limit, and the consumption amount cumulative total computation unit corrects the i-th recording consumption amount cumulative total to be divided by the reference divisor and corrects the i-th total consumption amount cumulative total to be divided by the reference divisor when the cumulative total upper limit determining unit determines that the i-th total consumption amount cumulative total exceeds the cumulative total upper limit.

In this case, when the i-th total consumption amount cumulative total exceeds the cumulative total upper limit, each of the i-th recording consumption amount cumulative total and the i-th total consumption amount cumulative total is corrected by being divided by the reference divisor. Thus, the i-th recording consumption amount cumulative total and the total consumption amount cumulative total become small. Accordingly, the recording consumption amount cumulative total after the i-th recording job becomes a value on which the recording consumption amount after the i-th recording job is more greatly reflected, and the total consumption amount cumulative total after the i-th recording job becomes a value on which the recording consumption amount and the non-recording consumption amount after the i-th recording job are more greatly reflected. Therefore, the ink distribution ratio after the i-th recording job can be obtained as a value on which the recording consumption amount and the non-recording consumption amount after the i-th recording job are more greatly reflected, that is, a value on which the immediately previous operation status of the recording apparatus is more greatly reflected.

It is preferable that the information processing device further includes a distribution target amount computation unit that computes an i-th distribution target amount on the basis of the i-th recording consumption amount, and a distribution upper limit determining unit that determines whether the i-th non-recording consumption amount exceeds the i-th distribution target amount, in which the distribution target amount computation unit does not correct the i-th non-recording consumption amount when the distribution upper limit determining unit determines that the i-th non-recording consumption amount is less than or equal to the i-th distribution target amount, and the distribution target amount computation unit corrects the i-th non-recording consumption amount to be the i-th distribution target amount when the distribution upper limit determining unit determines that the i-th non-recording consumption amount exceeds the i-th distribution target amount.

In this case, when the i-th recording consumption amount is not so great while the i-th non-recording consumption amount is great, the i-th non-recording consumption amount is corrected to be the i-th distribution target amount. This can suppress the ink distribution amount distributed to the i-th recording job being distributed excessively when the i-th recording consumption amount is not so great.

It is preferable that the information processing device further includes a setting value operating unit that is operated by a user inputting a setting value as a parameter which is used when the distribution target amount computation unit computes the i-th distribution target amount, and a setting value storage unit that stores the setting value which is input from the setting value operating unit.

In this case, a user can set the setting value in order for the i-th distribution target amount to be computed appropriately.

It is preferable that the information processing device further includes a carry-over target amount computation unit that computes an i-th carry-over target amount to be zero when the distribution upper limit determining unit determines that the i-th non-recording consumption amount is less than or equal to the i-th distribution target amount and computes the i-th carry-over target amount on the basis of a value obtained from subtraction of the i-th distribution target amount from the i-th non-recording consumption amount when the distribution upper limit determining unit determines that the i-th non-recording consumption amount exceeds the i-th distribution target amount, a next carry-over amount storage unit that stores an (i−1)-th next carry-over amount, an addition amount computation unit that computes an i-th addition amount on the basis of a value obtained from addition of the (i−1)-th next carry-over amount and the i-th carry-over target amount, and a next carry-over amount computation unit that computes the i-th next carry-over amount on the basis of a value obtained from subtraction of the i-th addition amount from a value obtained from addition of the (i−1)-th next carry-over amount and the i-th carry-over target amount, in which the ink distribution amount computation unit computes the i-th ink distribution amount on the basis of a value obtained from addition of the i-th addition amount and a value obtained from multiplication of the ink distribution ratio by the i-th recording consumption amount.

In this case, when the i-th non-recording consumption amount exceeds the i-th distribution target amount, a part of the i-th carry-over target amount which is the exceeding amount can be distributed to the i-th recording job as the i-th addition amount. In addition, including a case where the i-th non-recording consumption amount is less than or equal to the i-th distribution target amount, a part of the (i−1)-th next carry-over amount, which is the remaining amount of each carry-over target amount until the (i−1)-th recording job without being distributed as the addition amount until the (i−1)-th recording job, can be distributed to the i-th recording job as the i-th addition amount. Accordingly, the cumulative total of the ink distribution amount from the first to the i-th recording jobs can approximate to the cumulative total of the actual amount of ink consumed in the first to the i-th recording jobs, and the ink distribution amount can be computed more appropriately.

It is preferable that the information processing device further includes an addition ratio storage unit that stores a first addition ratio which is a number between zero and one inclusive and a second addition ratio which is a number greater than the first addition ratio between zero and one inclusive, in which the addition amount computation unit computes the i-th addition amount on the basis of a value obtained from multiplication of the first addition ratio by a value obtained from addition of the (i−1)-th next carry-over amount and the i-th carry-over target amount when the distribution upper limit determining unit determines that the i-th non-recording consumption amount is less than or equal to the i-th distribution target amount, and the addition amount computation unit computes the i-th addition amount on the basis of a value obtained from multiplication of the second addition ratio by a value obtained from addition of the (i−1)-th next carry-over amount and the i-th carry-over target amount when the distribution upper limit determining unit determines that the i-th non-recording consumption amount exceeds the i-th distribution target amount.

In this case, the i-th addition amount is computed on the basis of the first addition ratio, which is smaller than the second addition ratio, when the i-th non-recording consumption amount is less than or equal to the i-th distribution target amount, that is, when the i-th carry-over target amount is zero. Thus, the i-th addition amount is comparatively small. Conversely, the i-th addition amount is computed on the basis of the second addition ratio, which is greater than the first addition ratio, when the i-th non-recording consumption amount exceeds the i-th distribution target amount, that is, when the i-th carry-over target amount is greater than zero. Thus, the i-th addition amount is comparatively great. This can suppress the i-th next carry-over amount being excessively great.

It is preferable that the information processing device further includes an addition ratio operating unit that is operated by a user inputting the first addition ratio and the second addition ratio, and a setting value storage unit that stores the first addition ratio and the second addition ratio which are input from the addition ratio operating unit.

In this case, a user can set the first addition ratio and the second addition ratio in order for the i-th addition amount to be computed appropriately.

It is preferable that the information processing device further includes an output control unit that outputs the i-th ink distribution amount to at least one of a display unit and an external device.

In this case, a user can easily understand the computed ink distribution amount via at least one of the display unit and the external device.

It is preferable that the information processing device further includes a unit price storage unit that stores a unit price of ink, and a cost computation unit that computes an ink cost for the i-th recording job on the basis of a value obtained from multiplication of the unit price of ink by the i-th ink distribution amount.

In this case, the ink cost for the i-th recording job can be appropriately computed at the time of the end of the i-th recording job.

BRIEF DESCRIPTION OF THE DRAWINGS

The invention will be described with reference to the accompanying drawings, wherein like numbers reference like elements.

FIG. 3 is a diagram illustrating a computation result from an ink cost computation process according to a comparative example.

FIGS. 7A to 7E are diagrams for describing a cumulative total upper limit and a reference divisor in the ink distribution amount computation process.

FIG. 8 is a diagram illustrating a computation result from the ink distribution amount computation process according to an embodiment.

DESCRIPTION OF EXEMPLARY EMBODIMENTS

Hereinafter, a description will be provided for an ink jet recording apparatus according to an embodiment of the invention with reference to the appended drawings.

Figure 1:
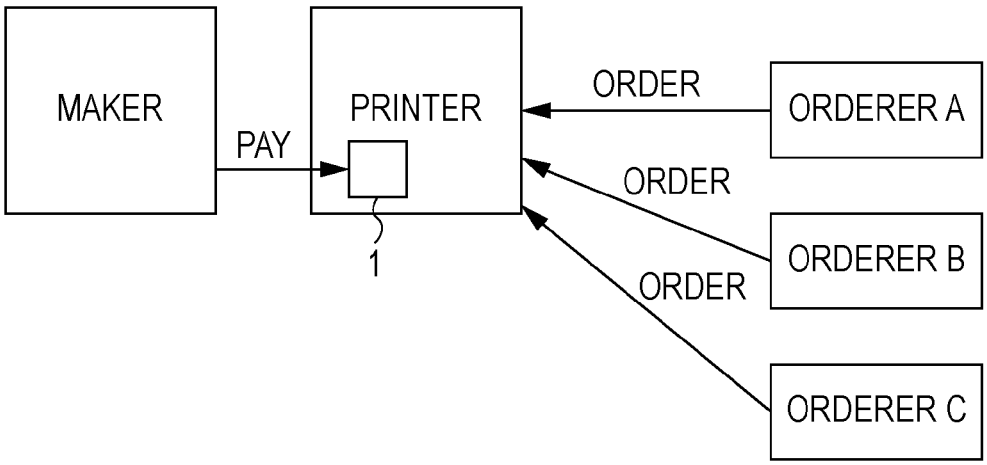
FIG. 1 is a diagram for describing a maker, a printer, and an orderer in relation to an ink jet recording apparatus.

An ink jet recording apparatus 10 is supplied to a printer from a maker and is used by the printer as illustrated in FIG. 1. The ink jet recording apparatus 10 performs a recording job of recording an image on a recording medium according to an order from an orderer. The ink jet recording apparatus 10, although will be described in detail later, computes the amount of distribution of ink for each recording job.

The ink jet recording apparatus 10 doubles as a "recording device" and an "information processing device" in the present embodiment. That is to say, an information processing device is incorporated into the ink jet recording apparatus 10. However, not limited to this, an information processing device computing the amount of distribution of ink in the same manner as the ink jet recording apparatus 10 in the present embodiment may be disposed separately from the ink jet recording apparatus 10.

The ink jet recording apparatus 10 not only consumes ink in a recording job of recording an image on a recording medium through discharge of ink but also performs a maintenance process as a non-recording job except a recording job before each recording job. The maintenance process is a process of discharging ink from an ink jet head and an ink supply flow passage so as to resolve discharge failure and the like.

The maintenance process includes a timer cleaning that is performed automatically and a manual cleaning that is performed manually. The manual cleaning is necessarily performed a predetermined number of times before each recording job according to, for example, an agreement between a printer and an orderer. Meanwhile, the timer cleaning is not necessarily performed before each recording job because the timer cleaning is performed at each specified time.

The present embodiment considers a case of using an ink such as a white ink that particularly needs to be processed through the maintenance process since pigments therein easily settles, and the ratio of use thereof is low. Thus, the manual cleaning is performed at all times before each recording job in that case. However, in a case of not using such an ink, the manual cleaning is not necessarily performed at all times before each recording job.

A problem arises in how to distribute the amount of ink consumed through the maintenance process to each recording job. To clarify this problem, a comparative example will be first described prior to the description of an ink distribution amount computation process performed by the ink jet recording apparatus 10 in the present embodiment.

An ink cost computation process according to the comparative example is a process of computing a value, as an ink cost, through the multiplication of the unit price of ink and the total amount of ink obtained by adding the amount of ink consumed through the maintenance process performed before a recording job, that is, the non-recording consumption amount to the amount of ink consumed in the recording job, that is, the recording consumption amount.

According to the ink cost computation process in the comparative example, the ink cost differs depending on whether the timer cleaning is performed before a recording job even when printing orders are placed for the same image. An orderer does not know whether the timer cleaning is performed. Thus, such an ink cost computation process makes the orderer feel distrust and unfairness.

Figure 2:
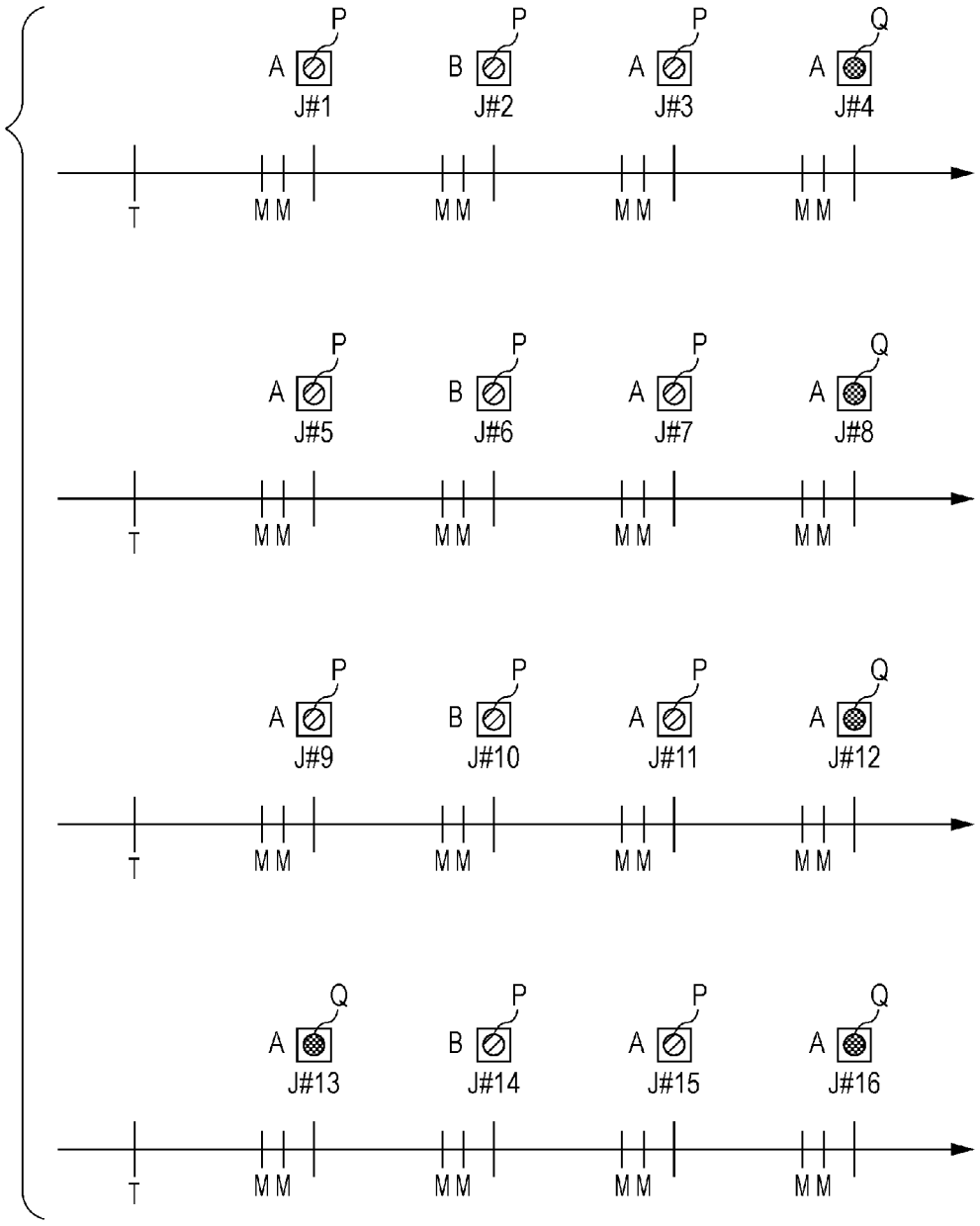
FIG. 2 is a diagram illustrating an example of the operation status of the ink jet recording apparatus.

A description will be provided more specifically with reference to FIG. 2 and FIG. 3. It is apparent that the amount of ink exemplified herein and consumed in the timer cleaning or the manual cleaning is merely a simple example. In actuality, the amount of ink differs depending on models of the ink jet recording apparatus 10, types of ink, and the like. This also applies to the subsequent description in the same manner.

A description will be first provided for the operation status of the ink jet recording apparatus 10 as a basis for the computation of the ink cost. Here, 16 recording jobs (illustrated with "J" in FIG. 2), that is, a recording job #1 to a recording job #16 are performed. An orderer B places orders for the recording job #2, the recording job #6, the recording job #10, and the recording job #14. An orderer A places orders for other recording jobs. An image Q is recorded through the recording job #4, the recording job #8, the recording job #12, the recording job #13, and the recording job #16. An image P is recorded through other recording jobs. The recording consumption amount is 2 g in recording jobs of recording the image P. The recording consumption amount is 12 g in recording jobs of recording the image Q.

The manual cleaning (illustrated with "M" in FIG. 2) is performed twice before each recording job. The amount of ink consumed in one manual cleaning is 2.5 g. The timer cleaning (illustrated with "T" in FIG. 2) is performed before the recording job #1, the recording job #5, the recording job #9, and the recording job #13. The amount of ink consumed in one timer cleaning is 10 g. Thus, the non-recording consumption amount is 15 g (=(2.5 g×2)+10 g) in the recording job #1, the recording job #5, the recording job #9, and the recording job #13. The non-recording consumption amount is 5 g (=2.5 g×2) in other recording jobs. The unit price of ink is 10 yen/g.

The ink cost is computed on the above basis through the ink cost computation process according to the comparative example. The result is represented at the right of a table in FIG. 3. From the computation result, even though the same image P is recorded, the ink cost is 70 yen in the recording job #2, the recording job #3, the recording job #6, the recording job #7, the recording job #10, the recording job #11, the recording job #14, and the recording job #15 while the ink cost is 170 yen in the recording job #1, the recording job #5, and the recording job #9 before which the timer cleaning is performed immediately. Similarly, even though the same image Q is recorded, the ink cost is 170 yen in the recording job #4, the recording job #8, the recording job #12, and the recording job #16 while the ink cost is 270 yen in the recording job #13 before which the timer cleaning is performed immediately. From a different perspective, the ink cost in the recording job #1, the recording job #5, and the recording job #9 of recording the image P is 170 yen, and this is the same as the ink cost in the recording job #4, the recording job #8, the recording job #12, and the recording job #16 of recording the image Q even though the recording consumption amount is small in the former case, compared with that in the latter case.

For this reason, the orderer A, for example, feels distrust when comparing the recording job #1 and the recording job #3 since the ink cost differs in those jobs even though the same image P is recorded. The orderer A also feels distrust when comparing the recording job #1 and the recording job #4 since the ink cost is the same in those jobs even though different images are recorded. Furthermore, the orderer B places four orders for the image P at an ink cost of 70 yen for each order. This makes the orderer A feel unfairness when the orderer A obtains information such as "Our company places four orders for the image P at an ink cost of 70 yen for each order." from the orderer B since the ink cost for recording the image P is 170 yen for the orderer A in some cases.

Regarding this point, the ink distribution amount computation process performed by the ink jet recording apparatus 10 in the present embodiment is intended not to make an orderer feel such distrust and unfairness at all.

Figure 4:
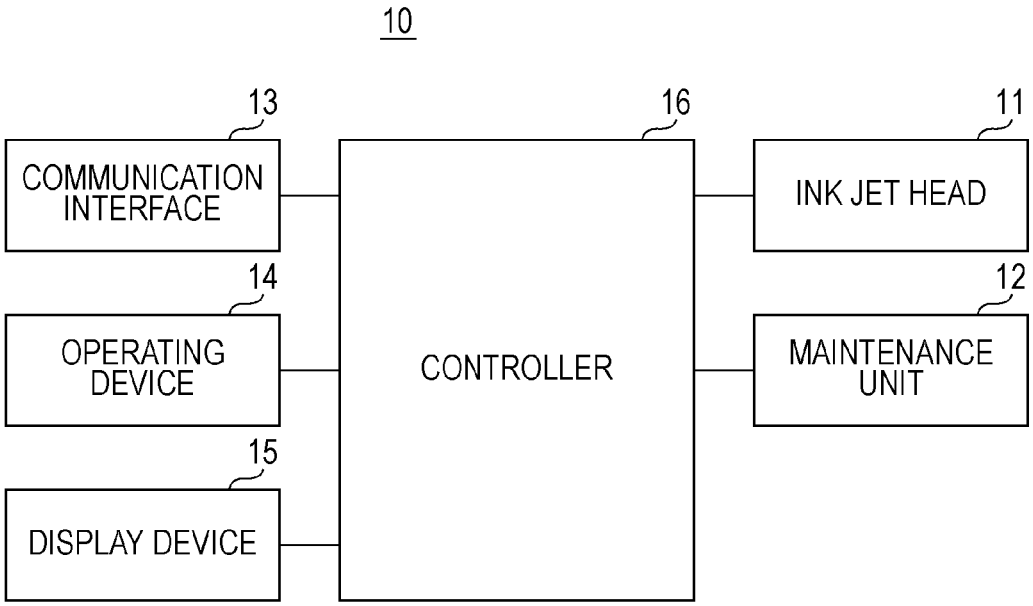
FIG. 4 is a diagram illustrating an example of the hardware configuration of the ink jet recording apparatus.

A description will be provided for an example of the hardware configuration of the ink jet recording apparatus 10 with reference to FIG. 4. The ink jet recording apparatus 10 is provided with an ink jet head 11, a maintenance unit 12, a communication interface 13, an operating device 14, a display device 15, and a controller 16.

The ink jet head 11 discharges ink to a recording medium.

The maintenance unit 12 is configured by, for example, a cap member for capping the ink jet head 11, a suction pump for sucking the ink jet head 11 through the cap member, and the like. The maintenance unit 12 performs the maintenance process of discharging ink from the ink jet head 11 and an ink supply flow passage.

The communication interface 13 is configured by, for example, a transceiver circuit. The communication interface 13 communicates with external devices such as an information processing terminal to receive and supply various pieces of data to the controller 16 or to transmit data supplied from the controller 16. Examples of the information processing terminal may include a personal computer, a smartphone, a tablet terminal, and the like.

The operating device 14 is configured by, for example, operating buttons. The operating device 14 is operated by a user.

The display device 15 is configured by, for example, a liquid crystal display or an organic EL display. The display device 15 displays various pieces of information such as the computed ink cost to a user.

The controller 16 is configured by, for example, an unillustrated central processing unit (CPU), a read-only memory (ROM), and a random access memory (RAM). The CPU of the controller 16 loads a program from the ROM into the RAM and executes the program to control the entire operation of the ink jet recording apparatus 10.

Figure 5:
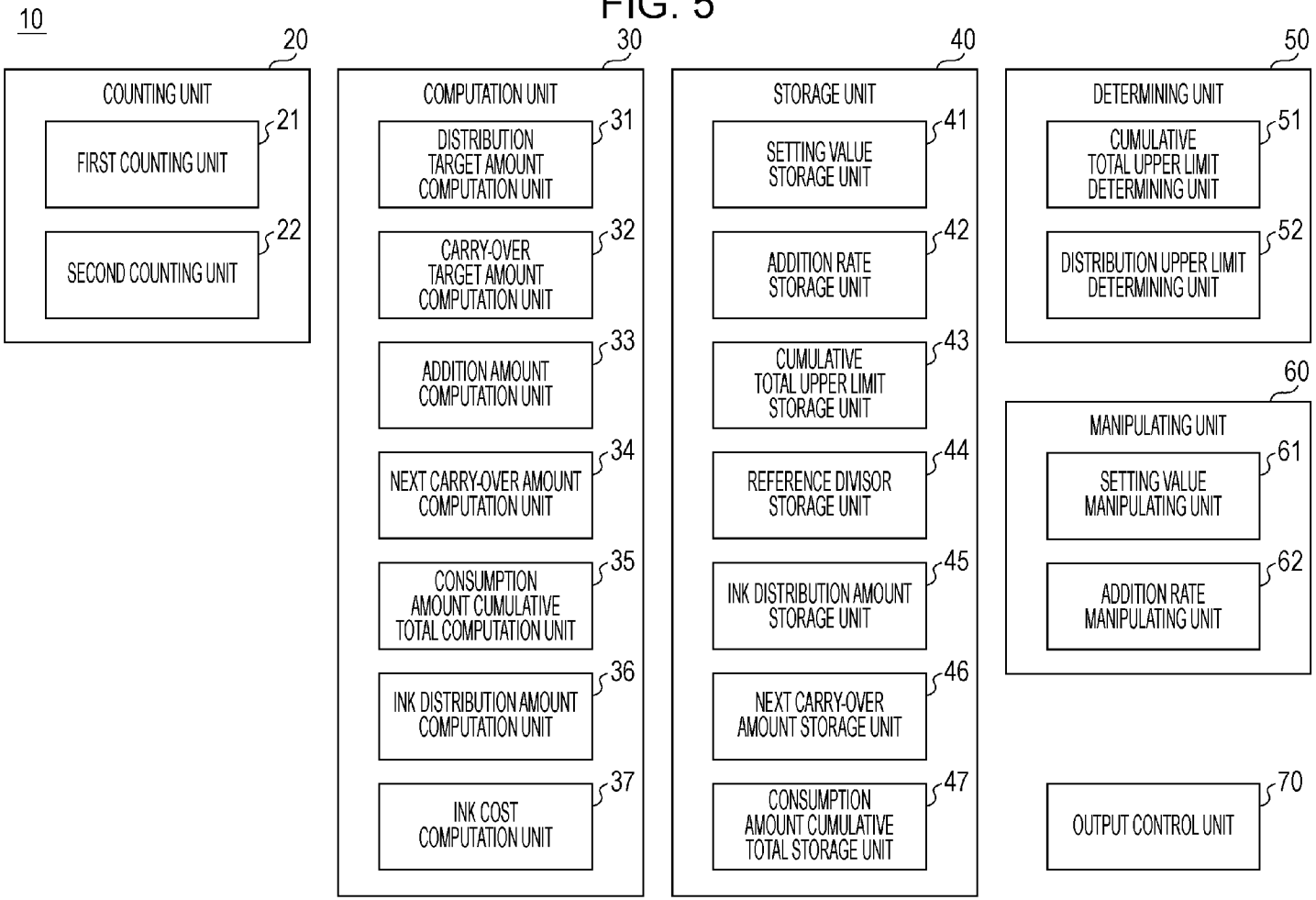
FIG. 5 is a diagram illustrating an example of the functional configuration of the ink jet recording apparatus.

A description will be provided for an example of the functional configuration of the ink jet recording apparatus 10 with reference to FIG. 5. At least a part of the functional units illustrated in FIG. 5 is realized by the controller 16 in FIG. 4 executing a predetermined program.

The ink jet recording apparatus 10 is provided with a counting unit 20, a computation unit 30, a storage unit 40, a determining unit 50, an operating unit 60, and an output control unit 70.

The counting unit 20 is provided with a first counting unit 21 and a second counting unit 22.

The computation unit 30 is provided with a distribution target amount computation unit 31, a carry-over target amount computation unit 32, an addition amount computation unit 33, a next carry-over amount computation unit 34, a consumption amount cumulative total computation unit 35, an ink distribution amount computation unit 36, and an ink cost computation unit 37.

The storage unit 40 is provided with a setting value storage unit 41, an addition ratio storage unit 42, a cumulative total upper limit storage unit 43, a reference divisor storage unit 44, an ink distribution amount storage unit 45, a next carry-over amount storage unit 46, and a consumption amount cumulative total storage unit 47.

The determining unit 50 is provided with a cumulative total upper limit determining unit 51 and a distribution upper limit determining unit 52.

The operating unit 60 is provided with a setting value operating unit 61 and an addition ratio operating unit 62.

Figure 6:
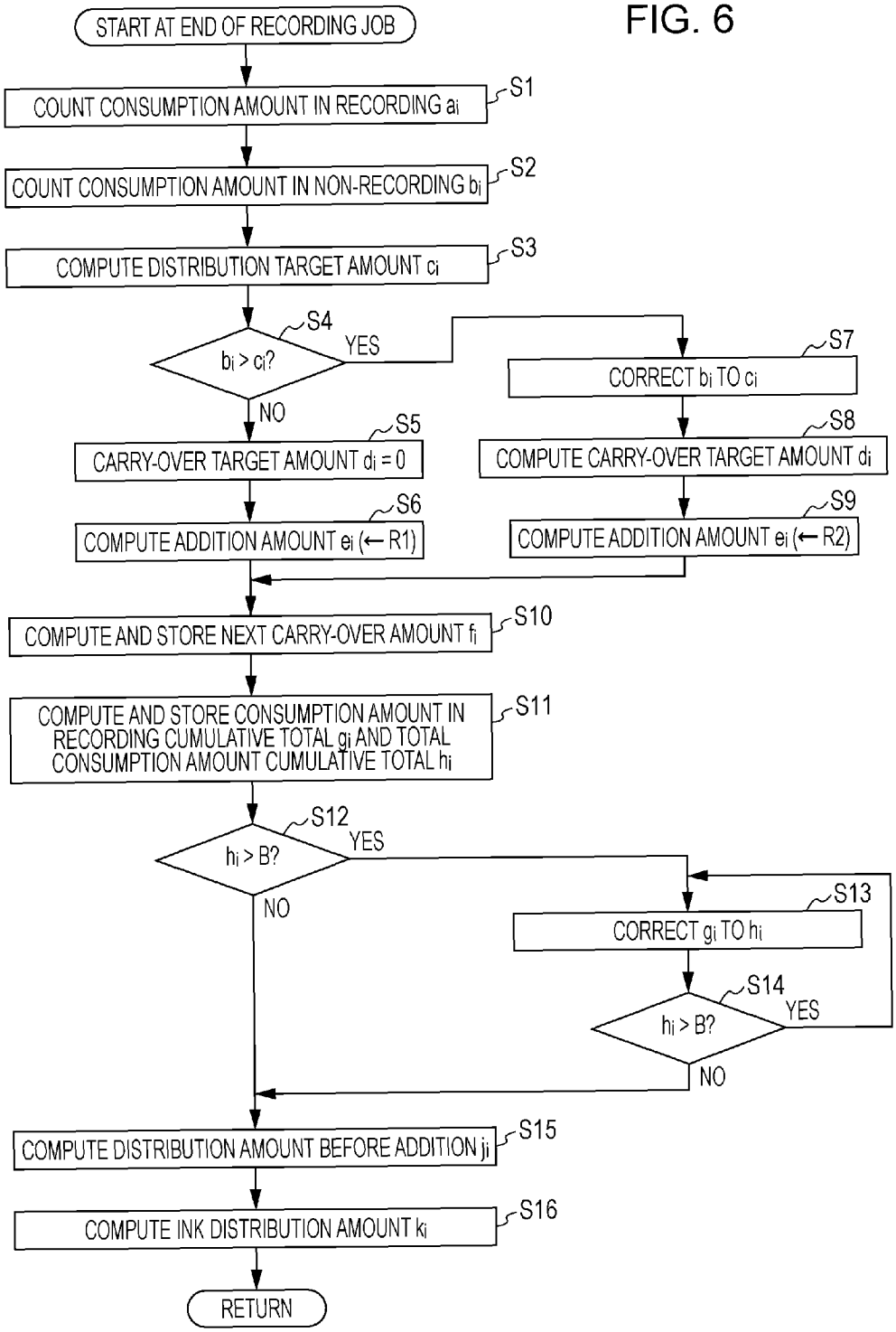
FIG. 6 is a flowchart illustrating an example of an ink distribution amount computation process by the ink jet recording apparatus.

A description will be provided for a process performed by the ink jet recording apparatus 10 according to the flowchart in FIG. 6 while referring to FIG. 5.

The first counting unit 21 counts an i-th recording consumption amount $a_i$ (where i is an integer greater than or equal to one) when an i-th recording job ends (S1). The first counting unit 21, for example, counts the number of discharges of ink from the ink jet head 11 in the i-th recording job and multiplies the number of discharges by the amount of ink droplets to compute the recording consumption amount $a_i$.

Next, the second counting unit 22 counts an i-th non-recording consumption amount $b_i$ (S2). The second counting unit 22, for example, counts the number of performances of each of the manual cleaning and the timer cleaning between an (i−1)-th recording job and the i-th recording job and multiplies the number of performances by the amount of ink consumed through one manual cleaning or one timer cleaning to compute the i-th non-recording consumption amount $b_i$.

Next, the distribution target amount computation unit 31 computes an i-th distribution target amount $c_i$ on the basis of Equation (1) (S3).

$$c_i = A1 \times a_i + A2 \quad (1)$$

A1: first setting value

A2: second setting value

Parameters of Equation (1), the first setting value (A1) and the second setting value (A2), can be arbitrarily set by a user using the setting value operating unit 61. The first setting value (A1) and the second setting value (A2) set by the setting value operating unit 61 are stored on the setting value storage unit 41. The preferred range of the first setting value (A1) and the second setting value (A2) depends on the operation status of the ink jet recording apparatus 10, but, for example, the first setting value (A1) is between one and two inclusive, and the second setting value (A2) is between zero and one inclusive. A user sets the first setting value (A1) and the second setting value (A2) on the basis of experience in order for the i-th distribution target amount $c_i$ to be computed appropriately. In the present embodiment, A1 is set to 1.5, and A2 is set to 0.5.

Examples of a user include a printer and a maker.

Next, the distribution upper limit determining unit 52 determines whether the i-th non-recording consumption amount $b_i$ exceeds the i-th distribution target amount $c_i$ (S4).

In step 4, when the distribution upper limit determining unit 52 determines that the i-th non-recording consumption amount $b_i$ is less than or equal to the i-th distribution target amount $c_i$ (No in S4), the carry-over target amount computation unit 32 computes an i-th carry-over target amount $d_i$ as zero (S5).

The addition amount computation unit 33 computes an i-th addition amount $e_i$ on the basis of Equation (2-1) (S6). Although will be described in detail later, the computed i-th addition amount $e_i$ is added to an i-th ink distribution amount $k_i$.

$$e_i = (f_{i-1} + d_i) \times R1 \quad (2\text{-}1)$$

$f_i$: i-th next carry-over amount

R1: first addition ratio

Here, an (i−1)-th next carry-over amount $f_{i-1}$ is read from the next carry-over amount storage unit 46 which will be described later.

The first addition ratio R1, along with a second addition ratio R2 which will be described later, can be arbitrarily set by a user using the addition ratio operating unit 62.

Meanwhile, in step 4, when the distribution upper limit determining unit 52 determines that the i-th non-recording consumption amount $b_i$ exceeds the i-th distribution target amount $c_i$ (Yes in S4), the distribution target amount computation unit 31 corrects the i-th non-recording consumption amount $b_i$ to be the i-th distribution target amount $c_i$ (S7). As such, when the i-th recording consumption amount $a_i$ is not so great while the i-th non-recording consumption amount $b_i$ is great, the i-th non-recording consumption amount $b_i$ is corrected to be the i-th distribution target amount $c_i$. This can suppress the i-th ink distribution amount $k_i$ (will be described later) being distributed excessively when the i-th recording consumption amount $a_i$ is not so great.

The carry-over target amount computation unit 32 computes the i-th carry-over target amount $d_i$ on the basis of Equation (3) (S8).

$$d_i = b_i - c_i \quad (3)$$

The addition amount computation unit 33 computes the i-th addition amount $e_i$ on the basis of Equation (2-2) (S9).

$$e_i = (f_{i-1} + d_i) \times R2 \quad (2\text{-}2)$$

R2: second addition ratio

The second addition ratio R2, along with the first addition ratio R1 above, can be set by a user using the addition ratio operating unit 62. The first addition ratio R1 and the second addition ratio R2 set by the addition ratio operating unit 62 are stored on the addition ratio storage unit 42. The first addition ratio R1 and the second addition ratio R2 are numbers between zero and one inclusive. The second addition ratio R2 is between zero and one inclusive and is greater than R1. A user sets the first setting value (A1) and the second setting value (A2) on the basis of experience in order for the i-th addition amount $e_i$ to be computed appropriately. In the present embodiment, R1 is set to 0.02, and R2 is set to 0.2.

As such, the i-th addition amount $e_i$ is computed on the basis of the first addition ratio R1, which is smaller than the second addition ratio R2, when the i-th non-recording consumption amount $b_i$ is less than or equal to the i-th distribution target amount $c_i$, that is, when the i-th carry-over target amount $d_i$ is zero. Thus, the i-th addition amount $e_i$ is comparatively small. Conversely, the i-th addition amount $e_i$ is computed on the basis of the second addition ratio R2, which is greater than the first addition ratio R1, when the i-th non-recording consumption amount $b_i$ exceeds the i-th distribution target amount $c_i$, that is, when the i-th carry-over target amount $d_i$ is greater than zero. Thus, the i-th addition amount $e_i$ is comparatively great. This can suppress an i-th next carry-over amount $f_i$ being excessively great. This may be described with a familiar example. In repayment of a credit card loan, when a predetermined amount of money is paid by using revolving credit (corresponds to the carry-over target amount) in a certain month (corresponds to the recording job), increasing the amount of repayment in that month (corresponds to the addition amount) prevents the revolving balance in the next month (corresponds to the next carry-over amount) from increasing excessively.

In step 6 or step 9, the next carry-over amount computation unit 34 computes the next carry-over amount $f_i$ on the basis of Equation (4) after the computation of the i-th addition amount $e_i$ (S10).

$$f_i = f_{i-1} + d_i - e_i \quad (4)$$

Next, the consumption amount cumulative total computation unit 35 computes an i-th recording consumption amount cumulative total $g_i$ on the basis of Equation (5-1) and computes an i-th total consumption amount cumulative total $h_i$ on the basis of Equation (6-1) (S11).

$$g_i = a_i + g_{i-1} \quad (5\text{-}1)$$

$$h_i = a_i + b_i + h_{i-1} \quad (6\text{-}1)$$

The computed i-th recording consumption amount cumulative total $g_i$ and the i-th total consumption amount cumulative total $h_i$ are stored on the consumption amount cumulative total storage unit 47. An (i−1)-th recording consumption amount cumulative total $g_{i-1}$ and an (i−1)-th total consumption amount cumulative total $h_{i-1}$ are read from the consumption amount cumulative total storage unit 47. That is to say, the (i−1)-th recording consumption amount cumulative total $g_{i-1}$ and the (i−1)-th total consumption amount cumulative total $h_{i-1}$ are computed through the ink distribution amount computation process that is performed after an (i−1)-th recording job and are stored on the consumption amount cumulative total storage unit 47.

Next, the cumulative total upper limit determining unit 51 determines whether the i-th total consumption amount cumulative total $h_i$ exceeds a cumulative total upper limit B that is read from the cumulative total upper limit storage unit 43 (S12). In the present embodiment, B is set to 100 [g]. The cumulative upper limit B may be arbitrarily set by a user in the same manner as the first setting value (A1) and the like above but is preferably set to "1×10^ (the number of significant figures of the integer part of the recording consumption amount)". For example, in a case of a consumption amount [g] where the integer part of the maximum of one recording consumption amount has less than three digits in a potential market, the recording consumption amount cumulative total and the total consumption amount cumulative total are preferably corrected to be a consumption amount [g] in two digits in the same manner as the recording consumption amount in view of matching the significant figures of the integer part. Accordingly, the cumulative upper limit B is preferably the minimum number in three significant figures of the integer part, that is, 100 [g] in view of matching the number of significant figures of the integer part. When a potential market is not clear, the consumption amount for painting the maximum regular size paper that is defined in A series of ISO 216 and is applied to a recording apparatus may be set as the maximum amount of one recording consumption amount.

In step 12, when the cumulative total upper limit determining unit 51 determines that the i-th total consumption amount cumulative total $h_i$ exceeds the cumulative total upper limit B (Yes in S12), the consumption amount cumulative total computation unit 35 corrects the i-th recording consumption amount cumulative total $g_i$ on the basis of Equation (5-2) and corrects the i-th total consumption amount cumulative total $h_i$ on the basis of Equation (6-2) (S13).

$$g_i=(a_{i-1})/C \tag{5-2}$$

$$h_i=(a_i+b_i+h_{i-1})/C \tag{6-2}$$

C: reference divisor

After correction, the cumulative total upper limit determining unit 51 again determines whether the i-th total consumption amount cumulative total $h_i$ exceeds the cumulative total upper limit B (S14). That is to say, step 13 is repeated until the i-th total consumption amount cumulative total $h_i$ becomes less than or equal to the cumulative total upper limit B.

The reference divisor C is read from the reference divisor storage unit 44. C is set to 10 here. The reference divisor C may also be arbitrarily set by a user but is preferably set to "1×10^ (the number of significant figures of the integer part of the cumulative upper limit−2)". For example, in a case of a consumption amount [g] where the integer part of the maximum of one recording consumption amount has less than three digits in a potential market, the recording consumption amount cumulative total and the total consumption amount cumulative total are preferably corrected to be a consumption amount [g] in two digits in the same manner as the recording consumption amount in view of matching the significant figures of the integer part. Accordingly, the reference divisor C is preferably a multiple of 10 in view of matching the number of significant figures of the integer part and performing information processing operations efficiently.

The above point will be specifically described with reference to FIGS. 7A to 7E. As the i-th recording consumption amount cumulative total $g_i$ and the i-th total consumption amount cumulative total $h_i$ are greater, the reflection thereof on the ink distribution ratio after the i-th recording job becomes small. Thus, the cumulative total upper limit B is preferably small. Meanwhile, when the cumulative total upper limit B is excessively small, the reflection on the ink distribution ratio after the i-th recording job becomes excessively great. Thus, the cumulative total upper limit B preferably has the same number of significant figures as the number of significant figures of the integer part of the expected recording consumption amount.

In addition, when the reference divisor C is excessively great, the reflection on the ink distribution ratio after the i-th recording job becomes excessively great. Thus, the reference divisor preferably has the number of significant figures smaller than the number of significant figures of the cumulative total upper limit by two.

FIG. 7A illustrates a case where the cumulative total upper limit is not set, and the reference divisor C is 1. In this case, the reflection is small at all times. FIG. 7B illustrates a case where the cumulative total upper limit B is 1000, and the reference divisor C is 10. That is to say, the cumulative total upper limit B does not satisfy 1×10^ (the number of significant figures of the integer part of the recording consumption amount) and is the minimum number in four digits of the integer part, and the reference divisor C does not satisfy 1×10^ (the number of significant figures of the integer part of the cumulative total upper limit−2). In this case, the reflection on the current recording job immediately after correction is small, but the reflection on the next recording job is possible. FIG. 7C illustrates a case where the cumulative total upper limit B is 1000, and the reference divisor C is 100. That is to say, the cumulative total upper limit B does not satisfy 1×10^ (the number of significant figures of the integer part of the recording consumption amount) and is the minimum number in four digits of the integer part, and the reference divisor C satisfies 1×10^ (the number of significant figures of the integer part of the cumulative total upper limit−2). In this case, the reflection on the current recording job immediately after correction is small, but the reflection on the next recording job is appropriately possible. FIG. 7D illustrates a case where the cumulative total upper limit B is 100, and the reference divisor C is 10. That is to say, the cumulative total upper limit B satisfies 1×10^ (the number of significant figures of the integer part of the recording consumption amount) and is the minimum number in three digits of the integer part, and the reference divisor C satisfies 1×10^ (the number of significant figures of the integer part of the cumulative total upper limit−2). In this case, the reflection on the current recording job immediately after correction and the reflection on the next recording job are appropriately possible. FIG. 7E illustrates a case where the cumulative total upper limit B is 10, and the reference divisor C is 10. That is to say, the cumulative total upper limit B does not satisfy 1×10^ (the number of significant figures of the integer part of the recording consumption amount) and is the minimum number in two digits of the integer part, and the reference divisor C does not satisfy 1×10^ (the number of significant figures of the integer part of the cumulative total upper limit−2). In this case, the reflection on the current recording job immediately after correction and the reflection on the next recording job are possible, but the ink distribution ratio becomes excessively great, and the ink distribution amount excessively varies with respect to the same recording consumption amount. Thus, this case is not preferable.

As such, when the i-th total consumption amount cumulative total $h_i$ exceeds the cumulative total upper limit B, each of the i-th recording consumption amount cumulative total $g_i$ and the i-th total consumption amount cumulative total $h_i$ is corrected by being divided by the reference divisor C. Thus, the i-th recording consumption amount cumulative total $g_i$ and the i-th total consumption amount cumulative total $h_i$ become small. Accordingly, the recording consumption amount cumulative total after the i-th recording job becomes a value on which the recording consumption amount after the i-th recording job is more greatly reflected, and the total consumption amount cumulative total after the i-th recording job becomes a value on which the recording consumption amount and the non-recording consumption amount after the i-th recording job are more greatly reflected. Therefore, the ink distribution ratio after the i-th recording job can be obtained as a value on which the recording consumption amount and the non-recording consumption amount after the i-th recording job are more greatly reflected, that is, a value on which the immediately previous operation status of the ink jet recording apparatus 10 is more greatly reflected. In addition, the i-th ink distribution ratio ($h_i/g_i$) does not vary since the i-th recording consumption amount cumulative total $g_i$ and the i-th total consumption amount cumulative total $h_i$ are divided by the common reference divisor C.

Next, the ink distribution amount computation unit 36 computes an i-th pre-addition distribution amount $j_i$ on the basis of Equation (7) (S15).

$$j_i=a_i\times(h_i/g_i) \tag{7}$$

Meanwhile, in step 12, when the cumulative total upper limit determining unit 51 determines that the i-th total consumption amount cumulative total $h_i$ is less than or equal to the cumulative total upper limit B (No in S12), the i-th recording consumption amount cumulative total $g_i$ and the i-th total consumption amount cumulative total $h_i$ are not corrected, and the i-th pre-addition distribution amount $j_i$ is computed on the basis of Equation (7) as described above (S15).

Next, the ink distribution amount computation unit 36 computes the i-th ink distribution amount $k_i$ on the basis of Equation (8) (S16).

$$k_i=e_i+j_i \tag{8}$$

As such, when the i-th non-recording consumption amount $b_i$ exceeds the i-th distribution target amount $c_i$, a part of the i-th carry-over target amount $d_i$ which is the exceeding amount can be distributed to the i-th recording job as the i-th addition amount $e_i$. In addition, including a case where the i-th non-recording consumption amount $b_i$ is less than or equal to the i-th distribution target amount $c_i$, a part of the (i−1)-th next carry-over amount $f_{i-1}$, which is the remaining amount of each carry-over target amount until the (i−1)-th recording job without being distributed as the addition amount until the (i−1)-th recording job, can be distributed to the i-th recording job as the i-th addition amount $e_i$. Accordingly, the cumulative total of the ink distribution amount from the first to the i-th recording jobs can approximate to the cumulative total of the actual amount of ink consumed in the first to the i-th recording jobs, and the ink distribution amount can be computed more appropriately.

The computed i-th ink distribution amount $k_i$ is stored on the ink distribution amount storage unit 45. The ink distribution amount storage unit 45 can store the ink distribution amount in each recording job. The ink distribution amount corresponding to a specified recording job is read from the ink distribution amount storage unit 45 and is output to an external device according to instructions from the operating device 14 and the external device. The external device is configured to be capable of accepting an input of the unit price of ink and to be capable of computing the ink cost for a recording job on the basis of the input unit price of ink and the ink distribution amount. The ink jet recording apparatus 10 ends the process after performing the above processes.

The ink jet recording apparatus 10 may be configured to compute the ink cost on the basis of the unit price of ink input from the operating device 14 or on the basis of the unit price of ink stored in advance on a unit price storage unit of the ink jet recording apparatus 10.

The output control unit 70 outputs the computation result of the computed i-th ink distribution amount $k_i$ and the like to the display device 15. Accordingly, a user can easily understand the computation result via the display device 15.

FIG. 8 illustrates a result of the computation of the ink distribution amount performed by the ink jet recording apparatus 10 in the present embodiment. In FIG. 8, the ink cost computed by the external device is also illustrated for convenience. The unit price of ink is 10 yen/g. The operation status of the ink jet recording apparatus 10 here used as a basis for the computation of the ink cost is the same as that in the comparative example described above. Although a [g] is used as the unit of the ink distribution amount and the like, other units such as a [ml] and the like may also be used thereas. Hereinafter, descriptions will be specifically provided for a case where the recording job #3 ends and a case where the recording job #12 ends.

First, a description will be provided for a case where the recording job #3 ends.

In this case, the first counting unit 21 counts the third recording consumption amount $a_3$ to be 2 g (S1). Next, the second counting unit 22 counts the third non-recording consumption amount $b_3$ to be 5 g (S2). Next, the distribution target amount computation unit 31 computes the third distribution target amount $c_3$ to be 3.5 g on the basis of Equation (1) (S3).

$$c_3=A1\times a_3+A2=1.5\times 2+0.5=3.5\ [g]$$

In this case, the distribution upper limit determining unit 52 determines that the third non-recording consumption amount $b_3$ (=5 g) exceeds the third distribution target amount $c_3$ (=3.5 g) (Yes in S4). Thus, the distribution target amount computation unit 31 corrects the third non-recording consumption amount $b_3$ (=5 g) to be the third distribution target amount $c_3$ (=3.5 g) (S7). Next, the carry-over target amount computation unit 32 computes the third carry-over target amount $d_3$ to be 1.5 g on the basis of Equation (3) (S8).

$$d_3=b_3-c_3=5-3.5=1.5\ [g]$$

The addition amount computation unit 33 computes the third addition amount $e_3$ to be 2.01 g on the basis of Equation (2-2) (S9).

$$e_3=(f_2+d_3)\times R2=(8.56+1.5)\times 0.2=2.01\ [g]$$

The next carry-over amount computation unit 34 computes the next carry-over amount $f_3$ to be 8.05 g on the basis of Equation (4) after the third addition amount $e_3$ is computed (S10).

$$f_3=f_2+d_3-e_3=8.56+1.5-2.01=8.05\ [g]$$

Next, the consumption amount cumulative total computation unit 35 computes the third recording consumption amount cumulative total $g_3$ to be 6 g on the basis of Equation (5-1) and computes the third total consumption amount cumulative total $h_3$ to be 16.5 g on the basis of Equation (6-1) (S11).

$$g_3=a_3+g_2=2+4=6\ [g]$$

$$h_3=a_3+b_3+h_2=2+3.5+11=16.5\ [g]$$

In this case, the cumulative total upper limit determining unit 51 determines that the third total consumption amount cumulative total $h_3$ (=16.5 g) is less than or equal to the cumulative total upper limit B (=100 g) (No in S12). Thus, the ink distribution amount computation unit 36 computes the third pre-addition distribution amount $j_3$ to be 5.5 g on the basis of Equation (7) (S15).

$$j_3=a_3\times(h_3/g_3)=2\times(16.5/6)=5.5\ [g]$$

Next, the ink distribution amount computation unit 36 computes the third ink distribution amount $k_3$ to be 7.51 g on the basis of Equation (8) (S16).

$$k_3=e_3+j_3=2.01+5.5=7.51\ [g]$$

The computed third ink distribution amount $k_3$ is output to the external device, and the external device computes the third ink cost $m_3$ to be 75 yen.

Next, a description will be provided for a case where the recording job #12 ends.

In this case, the first counting unit 21 counts the twelfth recording consumption amount $a_{12}$ to be 12 g (S1). Next, the second counting unit 22 counts the twelfth non-recording consumption amount $b_{12}$ to be 5 g (S2). Next, the distribution target amount computation unit 31 computes the twelfth distribution target amount $c_{12}$ to be 18.5 g on the basis of Equation (1) (S3).

$$c_{12}=A1\times a_{12}+A2=1.5\times12+0.5=18.5\ [g]$$

In this case, the distribution upper limit determining unit 52 determines that the twelfth non-recording consumption amount $b_{12}$ (=5 g) is less than or equal to the twelfth distribution target amount $c_{12}$ (=18.5 g) (No in S4). Thus, the carry-over target amount computation unit 32 computes the twelfth carry-over target amount $d_{12}$ to be 0 g (S5).

The addition amount computation unit 33 computes the twelfth addition amount $e_{12}$ to be 0.28 g on the basis of Equation (2-1) (S6).

$$e_{12}=(f_{11}+d_{12})\times R1=(14.11+0)\times0.02=0.28\ [g]$$

The next carry-over amount computation unit 34 computes the next carry-over amount $f_{12}$ to be 13.83 g on the basis of Equation (4) after the twelfth addition amount $e_{12}$ is computed (S10).

$$f_{12}=f_{11}+d_{12}-e_{12}=14.11+0-0.28=13.83\ [g]$$

Next, the consumption amount cumulative total computation unit 35 computes the twelfth recording consumption amount cumulative total $g_{12}$ to be 54 g on the basis of Equation (5-1) and computes the twelfth total consumption amount cumulative total $h_{12}$ to be 100.5 g on the basis of Equation (6-1) (S11).

$$g_{12}=a_{12}+g_{11}=12+42=54\ [g]$$

$$h_{12}=a_{12}+b_{12}+h_{11}=12+5+83.5=100.5\ [g]$$

In this case, the cumulative total upper limit determining unit 51 determines that the twelfth total consumption amount cumulative total $h_{12}$ (=100.5 g) exceeds the cumulative total upper limit B (=100 g) (Yes in S12). Thus, the consumption amount cumulative total computation unit 35 corrects the twelfth recording consumption amount cumulative total $g_{12}$ to be 5.4 g on the basis of Equation (5-2) and corrects the twelfth total consumption amount cumulative total $h_{12}$ to be 10.05 g on the basis of Equation (6-2) (S13).

$$g_{12}=(a_{12}+g_{11})/C=(12+42)/10=5.4\ [g]$$

$$h_{12}=(a_{12}+b_{12}+h_{11})/C=(12+5+83.5)/10=10.05\ [g]$$

Next, the ink distribution amount computation unit 36 computes the twelfth pre-addition distribution amount $j_{12}$ to be 22.33 g on the basis of Equation (7) (S15).

$$j_{12}=a_{12}\times(h_{12}/g_{12})=12\times(10.05/5.4)=22.33\ [g]$$

Next, the ink distribution amount computation unit 36 computes the twelfth ink distribution amount $k_{12}$ to be 22.62 g on the basis of Equation (8) (S16).

$$k_{12}=e_{12}+j_{12}=0.28+22.33=22.62\ [g]$$

The computed twelfth ink distribution amount $k_{12}$ is output to the external device, and the external device computes the twelfth ink cost $m_{12}$ to be 226 yen.

From the computation result of the ink cost as computed in the above manner, the ink cost is between 72 yen and 85 yen in the recording job #1, the recording job #2, the recording job #3, the recording job #5, the recording job #6, the recording job #7, the recording job #9, the recording job #10, the recording job #11, the recording job #14, and the recording job #15, all of which record the same image P. In addition, the ink cost is between 225 yen and 258 yen in the recording job #4, the recording job #8, the recording job #12, the recording job #13, and the recording job #16, all of which record the same image Q.

Thus, the orderer A may feel that the ink costs of 78 yen and 75 yen are approximately the same and are acceptable when comparing the recording job #1 and the recording job #3 of recording the same image P. In addition, the orderer A may accept that the ink cost is higher for the image Q having a great recording consumption amount when comparing the recording job #1 recording the image P and the recording job #4 recording the image Q. Furthermore, when the orderer A obtains information such as "Our company places four orders for the image P at an ink cost of 70 yen for each order." from the orderer B, the orderer A can reply, "I place seven orders for the image P at approximately the same ink cost as yours" and does not feel unfairness.

According to the ink jet recording apparatus 10 described hereinbefore in the present embodiment, the i-th recording consumption amount cumulative total $g_i$ and the i-th total consumption amount cumulative total $h_i$ can be computed at the time of the end of the i-th recording job. The i-th ink distribution amount $k_i$ is computed on the basis of the i-th ink distribution ratio ($h_i/g_i$) which is the ratio of the i-th total consumption amount cumulative total $h_i$ to the computed i-th recording consumption amount cumulative total $g_i$. Thus, the i-th ink distribution amount $k_i$ on which the i-th ink distribution ratio ($h_i/g_i$), that is, the operation status of the ink jet recording apparatus 10 until the i-th recording job is reflected can be obtained. In addition, the reflection on the ink distribution amount $k_i$ is possible depending on the operation status even in a case of the same recording consumption amount $a_i$. Therefore, the ink distribution amount $k_i$ distributed to the i-th recording job can be appropriately computed at the time of the end of the i-th recording job.

The ink distribution amount computation process is described as being performed at each time a recording job ends in the present embodiment. However, not limited to this, the ink distribution amount computation process may be performed for a plurality of recording jobs at a time by storing each recording consumption amount and each non-recording consumption amount.

The ink jet recording apparatus 10 is used as a recording apparatus in the present embodiment. However, not particularly limited to the ink jet recording apparatus 10, any recording apparatus consuming ink may be used instead.

A series of processes in the ink distribution amount computation process described above can be performed by hardware or can be performed by software. When the series of processes is performed by a piece of software, a program constituting the piece of software is installed on a computer. The computer here includes a computer incorporated into a dedicated piece of hardware and, for example, a versatile personal computer that can perform various functions with various programs installed thereon.

Figure 9:
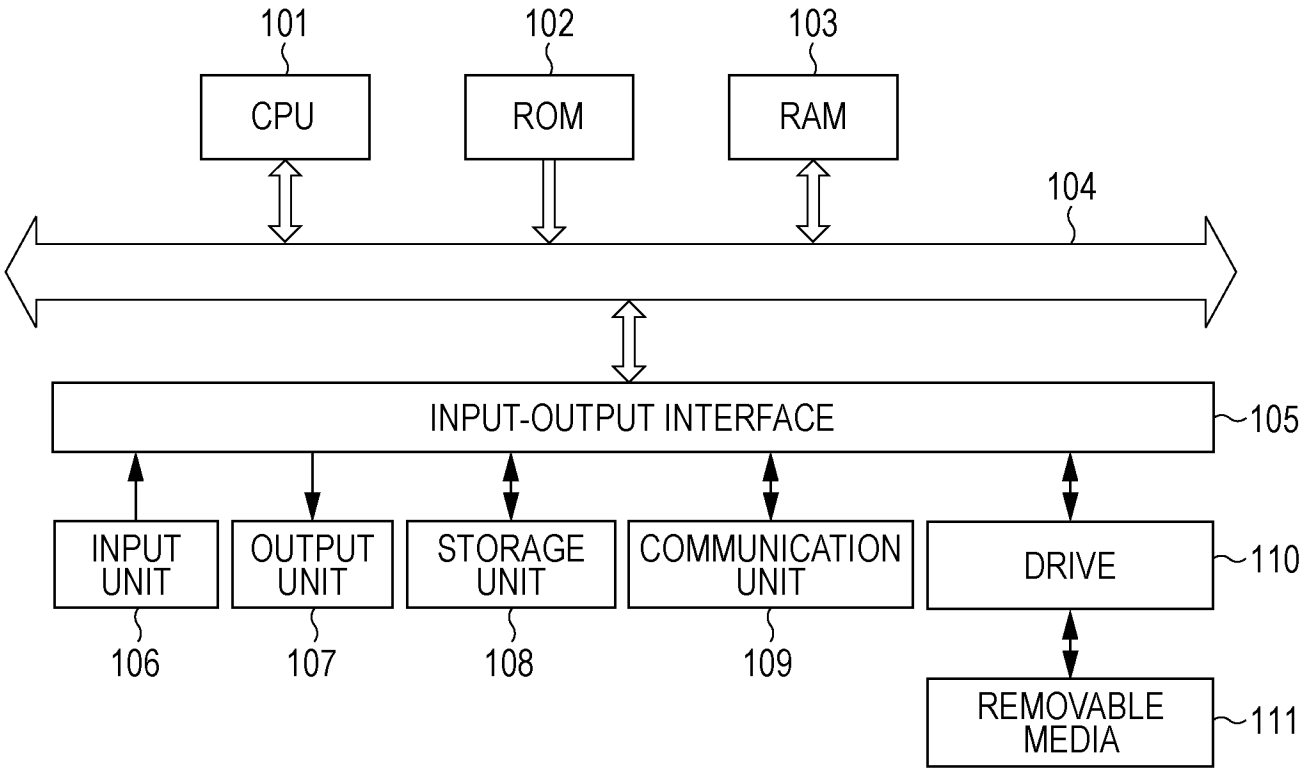
FIG. 9 is a diagram illustrating an example of the hardware configuration of a computer.

A description will be provided for an example of the hardware configuration of a computer that performs the series of processes described above with reference to FIG. 9.

A CPU 101, a ROM 102, and a RAM 103 are connected to each other through a bus 104 in the computer. An input-output interface 105 is further connected to the bus 104. An input unit 106, an output unit 107, a storage unit 108, a communication unit 109, and a drive 110 are connected to the input-output interface 105.

The input unit 106 is configured by a touch panel, a keyboard, a mouse, and the like. The output unit 107 is configured by a display, a speaker, and the like. The storage unit 108 is configured by a hard disk, a non-volatile memory, and the like. The communication unit 109 is configured by a network interface and the like. The drive 110 drives removable media 111 that are represented by an optical disc, a semiconductor memory, and the like.

The computer having the above configuration performs the series of processes described above with, for example, the CPU 101 loading a program stored on the storage unit 108 into the RAM 103 through the input-output interface 105 and the bus 104 and executing the program.

The program executed by the computer can be provided by, for example, being recorded on the removable media 111. In addition, the program can be provided through a wired or wireless transmission medium such as a local area network and the Internet.

The entire disclosure of Japanese Patent Application No. 2014-062309, filed Mar. 25, 2014 is expressly incorporated reference herein.

What is claimed is:

1. An information processing device comprising:

an ink distribution amount computation unit that computes an i-th (where i is an integer greater than or equal to one) ink distribution amount distributed to an i-th recording job which is performed by a recording apparatus according to an i-th ink distribution ratio obtained from division of an i-th total consumption amount cumulative total by an i-th recording consumption amount cumulative total.

2. The information processing device according to claim 1, further comprising:

a first counting unit that counts an i-th recording consumption amount which is the amount of ink consumed in the i-th recording job performed by the recording apparatus;

a second counting unit that counts an i-th non-recording consumption amount which is the amount of ink consumed in a non-recording job except the recording job, the non-recording job being performed by the recording apparatus between the (i−1)-th recording job and the i-th recording job;

a consumption amount cumulative total storage unit that stores the (i−1)-th recording consumption amount cumulative total and the (i−1)-th total consumption amount cumulative total; and a consumption amount cumulative total computation unit that computes the i-th recording consumption amount cumulative total on the basis of a value obtained from addition of the (i−1)-th recording consumption amount cumulative total and the i-th recording consumption amount and computes the i-th total consumption amount cumulative total on the basis of a value obtained from addition of the (i−1)-th total consumption amount cumulative total, the i-th recording consumption amount, and the i-th non-recording consumption amount, wherein the ink distribution amount computation unit computes the i-th ink distribution amount on the basis of a value obtained from multiplication of the i-th ink distribution ratio by the i-th recording consumption amount.

3. The information processing device according to claim 2, further comprising:

a cumulative total upper limit storage unit that stores a cumulative total upper limit;

a reference divisor storage unit that stores a reference divisor which is a number greater than one; and a cumulative total upper limit determining unit that determines whether the i-th total consumption amount cumulative total exceeds the cumulative total upper limit, wherein the consumption amount cumulative total computation unit does not correct the i-th recording consumption amount and the i-th total consumption amount cumulative total when the cumulative total upper limit determining unit determines that the i-th total consumption amount cumulative total is less than or equal to the cumulative total upper limit, and the consumption amount cumulative total computation unit corrects the i-th recording consumption amount cumulative total to be divided by the reference divisor and corrects the i-th total consumption amount cumulative total to be divided by the reference divisor when the cumulative total upper limit determining unit determines that the i-th total consumption amount cumulative total exceeds the cumulative total upper limit.

4. The information processing device according to claim 2, further comprising:

a distribution target amount computation unit that computes an i-th distribution target amount on the basis of the i-th recording consumption amount; and a distribution upper limit determining unit that determines whether the i-th non-recording consumption amount exceeds the i-th distribution target amount, wherein the distribution target amount computation unit does not correct the i-th non-recording consumption amount when the distribution upper limit determining unit determines that the i-th non-recording consumption amount is less than or equal to the i-th distribution target amount, and the distribution target amount computation unit corrects the i-th non-recording consumption amount to be the i-th distribution target amount when the distribution upper limit determining unit determines that the i-th non-recording consumption amount exceeds the i-th distribution target amount.

5. The information processing device according to claim 4, further comprising:

a setting value operating unit that is operated by a user inputting a setting value as a parameter which is used when the distribution target amount computation unit computes the i-th distribution target amount; and a setting value storage unit that stores the setting value which is input from the setting value operating unit.

6. The information processing device according to claim 4, further comprising:

a carry-over target amount computation unit that computes an i-th carry-over target amount to be zero when the distribution upper limit determining unit determines that the i-th non-recording consumption amount is less than or equal to the i-th distribution target amount and computes the i-th carry-over target amount on the basis of a value obtained from subtraction of the i-th distribution target amount from the i-th non-recording consumption amount when the distribution upper limit determining unit determines that the i-th non-recording consumption amount exceeds the i-th distribution target amount;

a next carry-over amount storage unit that stores an (i−1)-th next carry-over amount;

an addition amount computation unit that computes an i-th addition amount on the basis of a value obtained from addition of the (i−1)-th next carry-over amount and the i-th carry-over target amount; and a next carry-over amount computation unit that computes the i-th next carry-over amount on the basis of a value obtained from subtraction of the i-th addition amount from a value obtained from addition of the (i−1)-th next carry-over amount and the i-th carry-over target amount, wherein the ink distribution amount computation unit computes the i-th ink distribution amount on the basis of a value obtained from addition of the i-th addition amount and a value obtained from multiplication of the ink distribution ratio by the i-th recording consumption amount.

7. The information processing device according to claim 6, further comprising:

an addition ratio storage unit that stores a first addition ratio which is a number between zero and one inclusive and a second addition ratio which is a number greater than the first addition ratio between zero and one inclusive, wherein the addition amount computation unit computes the i-th addition amount on the basis of a value obtained from multiplication of the first addition ratio by a value obtained from addition of the (i−1)-th next carry-over amount and the i-th carry-over target amount when the distribution upper limit determining unit determines that the i-th non-recording consumption amount is less than or equal to the i-th distribution target amount, and the addition amount computation unit computes the i-th addition amount on the basis of a value obtained from multiplication of the second addition ratio by a value obtained from addition of the (i−1)-th next carry-over amount and the i-th carry-over target amount when the distribution upper limit determining unit determines that the i-th non-recording consumption amount exceeds the i-th distribution target amount.

8. The information processing device according to claim 7, further comprising:

an addition ratio operating unit that is operated by a user inputting the first addition ratio and the second addition ratio; and a setting value storage unit that stores the first addition ratio and the second addition ratio which are input from the addition ratio operating unit.

9. The information processing device according to claim 1, further comprising an output control unit that outputs the i-th ink distribution amount to at least one of a display unit and an external device.

10. The information processing device according to claim 1, further comprising:

a unit price storage unit that stores a unit price of ink; and a cost computation unit that computes an ink cost for the i-th recording job on the basis of a value obtained from multiplication of the unit price of ink by the i-th ink distribution amount.

11. A program that allows a computer to perform:

counting an i-th (where i is an integer greater than or equal to one) recording consumption amount which is the amount of ink consumed in an i-th recording job performed by a recording apparatus;

counting an i-th non-recording consumption amount which is the amount of ink consumed in a non-recording job except the recording job, the non-recording job being performed by the recording apparatus between the (i−1)-th recording job and the i-th recording job;

reading the (i−1)-th recording consumption amount cumulative total and an (i−1)-th total consumption amount cumulative total from a storage unit;

computing the i-th recording consumption amount cumulative total on the basis of a value obtained from addition of the (i−1)-th recording consumption amount cumulative total and the i-th recording consumption amount and computing the i-th total consumption amount cumulative total on the basis of a value obtained from addition of the (i−1)-th total consumption amount cumulative total, the i-th recording consumption amount, and the i-th non-recording consumption amount; and computing an i-th ink distribution amount distributed to the i-th recording job on the basis of a value obtained from multiplication of the i-th recording consumption amount by an i-th ink distribution ratio that is obtained from division of the i-th total consumption amount cumulative total by the i-th recording consumption amount cumulative total.

* * * * *